US006614189B2

(12) United States Patent
Yoon

(10) Patent No.: US 6,614,189 B2
(45) Date of Patent: Sep. 2, 2003

(54) FUNNEL FOR COLOR CRT

(75) Inventor: Thae Seok Yoon, Chilgok (KR)

(73) Assignee: LG Electronics Inc., Seoul (KR)

( * ) Notice: Subject to any disclaimer, the term of this patent is extended or adjusted under 35 U.S.C. 154(b) by 87 days.

(21) Appl. No.: 09/976,107

(22) Filed: Oct. 15, 2001

(65) Prior Publication Data

US 2002/0135306 A1 Sep. 26, 2002

(30) Foreign Application Priority Data

Feb. 13, 2001 (KR) ..... 2001-6885

(51) Int. Cl.[7] ..... G09G 1/28
(52) U.S. Cl. ..... 315/1; 315/366; 313/477
(58) Field of Search ..... 315/1, 364, 366, 315/370; 313/402, 407, 421, 422, 364, 472, 477

(56) References Cited

U.S. PATENT DOCUMENTS 5,859,508 A * 1/1999 Ge et al. ..... 315/366
6,002,203 A * 12/1999 Yokota et al. ..... 313/477
6,208,068 B1 * 3/2001 Lee et al. ..... 313/477
6,335,594 B2 * 1/2002 Park ..... 315/1

* cited by examiner

*Primary Examiner*—Don Wong
*Assistant Examiner*—Jimmy T. Vu
(74) *Attorney, Agent, or Firm*—Birch, Stewart, Kolasch & Birch, LLP

(57) ABSTRACT

A color CRT having a body portion coupled to a panel, a neck portion in which an electron gun is installed and a yoke portion formed to be connected between the body portion and the neck portion and in which a deflection coil is mounted, wherein an outer face of the yoke portion satisfies a relational expression of $0.6<\Delta HV/L<0.71$, of which 'L' indicates a diagonal length of an outer face of the yoke portion, 'H' indicates a long axis length of the outer face of the yoke portion, 'V' indicates a short axis length of the outer face of the yoke portion, $\Delta H$ indicates a difference between the diagonal length 'L' and the long axis length 'H', $\Delta V$ indicates a difference between the diagonal length 'L' and the short axis length 'V', $\Delta HV$ indicates the sum of $\Delta H$ and $\Delta V$. The funnel of a color CRT in accordance with the present invention is constructed such that the design range of the yoke portion is optimized when the screen ratio is about 16:9, so that the high luminance and a high frequency are satisfied, the deflection power is reduced, and the leakage magnetic field is reduced.

5 Claims, 5 Drawing Sheets

FUNNEL FOR COLOR CRT

BACKGROUND OF THE INVENTION

1. Field of the Invention

The present invention relates to a funnel for a color CRT, and more particularly, to a funnel for a color CRT that is capable of reducing a deflection power as well as a leakage magnetic field by modifying a structure of a yoke portion in which a deflection yoke is mounted.

2. Description of the Background Art

FIG. 1 is a partially cut side view showing an internal construction of a color CRT, and FIG. 2 is a sectional view taken along line A—A of FIG. 1, showing a structure of a yoke portion of a funnel of the color CRT in accordance with a conventional art.

With reference to FIG. 1, As shown in FIG. 1, a color CRT is formed with its external appearance by a panel 10 coated with a red, green and blue color fluorescent material 11 on the inner face thereof, and a funnel 20 sealed at the rear side of the panel 10 and maintaining an internal pressure in a high vacuum state.

A shadow mask 40 serving for color selection is mounted at the inner side of the panel 10 through the medium of a frame 30.

An inner shield 60 for shielding a magnetic field such as an earth magnetic field so that an electron beam (B) injected from an electron gun 80 is not influenced by the magnetic field is mounted at a rear side of the frame 30.

Especially, the funnel 20 includes a body portion 21 coupled to the panel 10, a neck portion 23 into which the electron gun 80 is installed, and a yoke portion 25 in a cone shape formed between the body portion 21 and the neck portion 23.

A deflection yoke 50 for deflecting the electron beam (B) injected from the electron gun 80 to the entire fluorescent surface 11 is mounted at the yoke portion 25.

In the color CRT, as the electron beam (B) irradiated from the electron gun 80 is deflected in the horizontal and the vertical direction by a static magnetic field of the deflection yoke 50, it collides with the fluorescent surface 11 formed at the inner surface of the panel 10, radiating the fluorescent material, so that an image is reproduced.

A cut-out section of the yoke portion 25 of the funnel 20 is typically formed to have a circular structure. But, in this respect, in order to reduce a power consumption of the deflection yoke 50, the maximum power consumption source, as shown in FIG. 3, a yoke portion 25' of a funnel 20' is formed to have a non-circular structure.

As a measure for minimizing the deflection power of the color CRT, the yoke portion 25' of the funnel 20' is designed in the following range.

With reference to FIGS. 4 and 5, on the assumption that a long axis length of the outer face of the yoke portion 25' is 'H', a short axis length of the outer face of the yoke portion 25' is 'V', a diagonal length of the outer face of the yoke portion 25' is 'L', $\Delta H=L-H$, $\Delta V=L-V$, $\Delta HV=\Delta H+\Delta V$, the yoke portion is designed in the range of $0.3<\Delta HV/L<0.6$.

However, the conventional designing range of the yoke portion is designed to be optimized in a color CRT of which screen ratio is 4:3, it is hardly optimized to be adoptable to a high definition television having a screen ratio of 16:9.

In other words, reduction of a power consumption in the deflection yoke, the maximum power consumption source, of the typical color CRT is a critical matter. In this respect, however, in order to improve a luminance of the fluorescent material of the color CRT, an anode voltage for accelerating the electron beam should be resultantly increased, it is difficult to reduce the power consumption of the deflection yoke.

Especailly, in case of a color CRT having the screen ratio of 16:9 such as the HDTV, a higher deflection force than that of the CRT having the screen ratio of 4:3, and at this time, the deflection frequency should be raised, causing problems that a deflection power is increased and a deflection magnetic field is readily leaked outside the CRT because of the deflection force caused due to the high frequency.

In addition, in line with the strengthened regulation for the leakage magnetic field, a compensation coil is additionally installed to reduce the leakage magnetic field, which, however, makes the structure of the color CRT more complicate and increases the power consumption.

As a result, the designing range of the yoke portion 25' in accordance with the convention is not suitable to the color CRT having the screen ratio of 16:9.

SUMMARY OF THE INVENTION

Therefore, an object of the present invention is to provide a funnel for a color CRT that is capable of reducing a deflection power and a leakage magnetic field while satisfying a high luminance or a high frequency by optimizing a design range of a yoke portion in case that a screen ratio is about 16:9.

To achieve these and other advantages and in accordance with the purpose of the present invention, as embodied and broadly described herein, there is provided a color CRT of which a funnel has a body portion coupled to a panel, a neck portion in which an electron gun is installed and a yoke portion connecting the body portion and the neck portion and having a deflection mounted therein, wherein the outer face of the yoke portion satisfies a relational expression of $0.6<\Delta HV/L<0.71$, of which 'L' indicates a diagonal length of an outer face of the yoke portion, 'H' indicates a long axis length of the outer face of the yoke portion, 'V' indicates a short axis length of the outer face of the yoke portion, $\Delta H$ indicates a difference between the diagonal length 'L' and the long axis length 'H', $\Delta V$ indicates a difference between the diagonal length 'L' and the short axis length 'V', $\Delta HV$ indicates the sum of $\Delta H$ and $\Delta V$.

In the funnel of a color CRT of the present invention, the outer face of the yoke portion satisfies a relational expression of $0.64<\Delta HV/L<0.71$.

In the funnel of a color CRT of the present invention, the yoke portion is formed in an about square shape, and the corner portion is thicker than both side portions and upper and lower portions.

In the funnel of a color CRT of the present invention, a sectional area from a reference line to the outer face of the yoke portion is 900~1200 $mm^2$.

To achieve the above objects, there is also provided a color CRT having a body portion coupled to a panel, a neck portion in which an electron gun is installed and a yoke portion formed to be connected between the body portion and the neck portion and in which a deflection coil is mounted, wherein the yoke portion satisfies a relational expression of $0.6<\Delta H'V'/L'<0.71$, of which 'L'' indicates a diagonal length of an inner face of the yoke portion, 'H'' indicates a long axis length of the inner face of the yoke portion, 'V'' indicates a short axis length of the inner face of the yoke portion, ΔH' indicates a difference between the diagonal length 'L'' and the long axis length 'H'', ΔV' indicates a difference between the diagonal length 'L'' and the short axis length 'V'', ΔH'V' indicates the sum of ΔH' and ΔV'.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A plurality of embodiments of a color CRT may exist, of which the most preferred embodiment will now be described.

Figure 6:
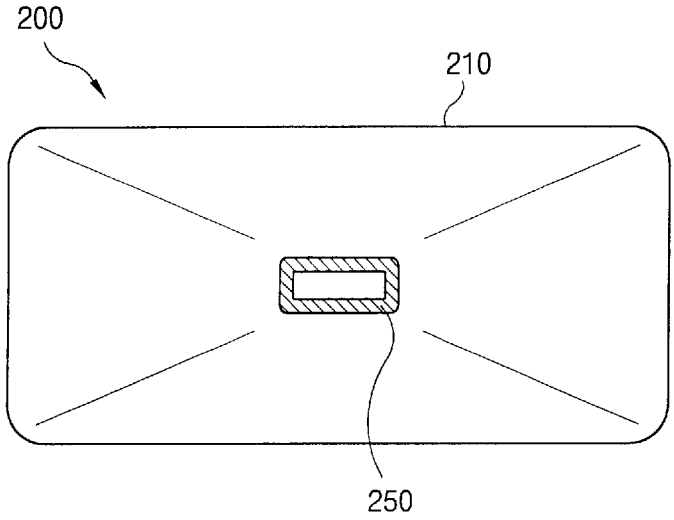
FIG. 6 is a sectional view showing a structure of a yoke portion of a funnel in accordance with a preferred embodiment of the present invention.

FIG. 6 is a partially cut rear view of a yoke portion of a funnel of a color CRT in accordance with a preferred embodiment of the present invention.

Like the color CRT of the conventional art, a color CRT adopting the funnel of the present invention also includes a panel 10 with a fluorescent surface 11 formed on the inner surface thereof, a funnel 20 sealed at a rear side of the panel 10, a shadow mask 40 serving for a color selection at the inner side of the panel 10, an electron gun 80 mounted at a neck portion of the funnel 20 and injecting the electron beam (B), and deflection yoke 50 for deflecting the electron beam (B) injected from the electron gun 80 to the entire fluorescent surface 11.

As shown in FIG. 6, the funnel 200 includes a body portion 210 coupled to the panel, a neck portion (not shown) in which the electron gun is mounted, and a yoke portion 250 in a cone shape formed between the body portion 210 and the neck portion and having the deflection yoke therein.

The neck portion of the funnel 200 has a circular section, the yoke portion 250 roughly has a rectangular section, and the body portion 210 is formed to a rectangular section of 16:9 ratio from an oval section.

The neck portion, the yoke portion 250 and the body portion 210 are formed extended as the circular shape, the rectangular shape, an oval shape and the rectangular shape of them are gently and successively connected.

Figure 7:
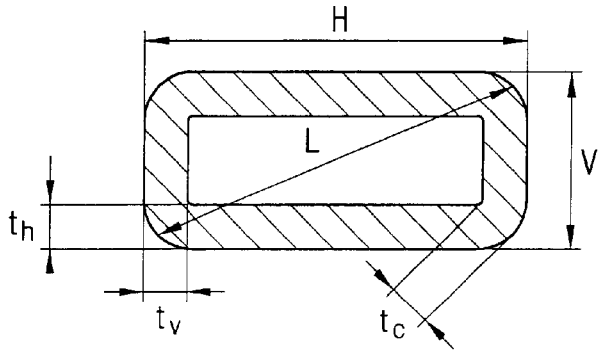
FIG. 7 is a sectional view for a reference of a design condition of an outer surface of the yoke portion in accordance with the preferred embodiment of the present invention.

Especially, with reference to FIG. 7, the yoke portion 250 is designed to satisfy the following relational expression of $0.6<\Delta HV/L<0.71$, on the assumption that 'L' indicates a diagonal length of an outer face of the yoke portion, 'H' indicates a long axis length of the outer face of the yoke portion, 'V' indicates a short axis length of the outer face of the yoke portion, ΔH indicates a difference between the diagonal length 'L' and the long axis length 'H', ΔV indicates a difference between the diagonal length 'L' and the short axis length 'V', ΔHV indicates the sum of ΔH and ΔV.

The design range of the yoke portion 250 is optimized when the screen is in the ratio of 16:9.

Figure 8:
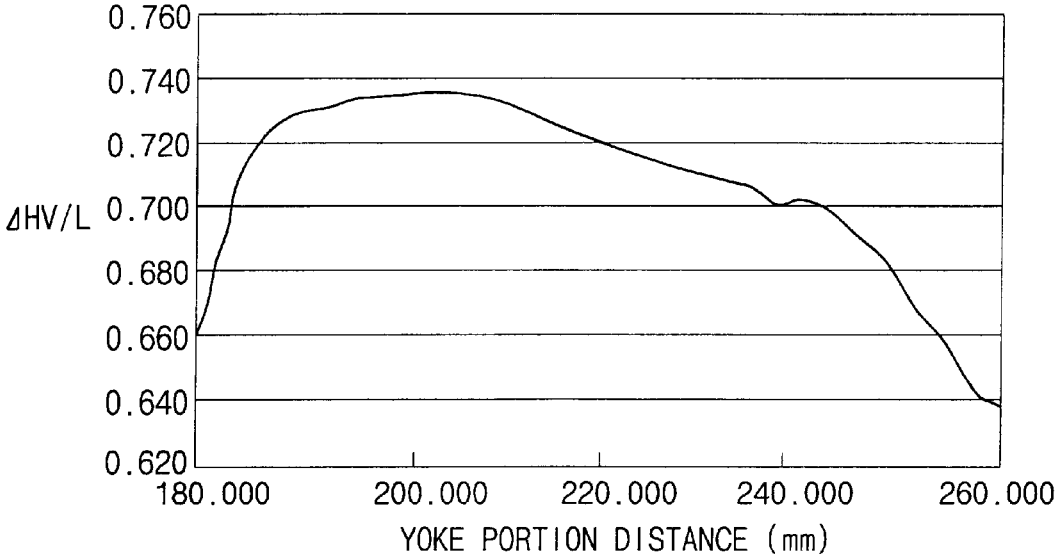
FIG. 8 is a graph showing a Δ HV/L value of each portion of the yoke portion in accordance with the preferred embodiment of the present invention.

FIG. 8 is a graph showing a Δ HV/L variation amount of the yoke portion 250 positioned between 180~260 mm, the distance from a sealing face where the funnel and the panel are attached.

Figure 9:
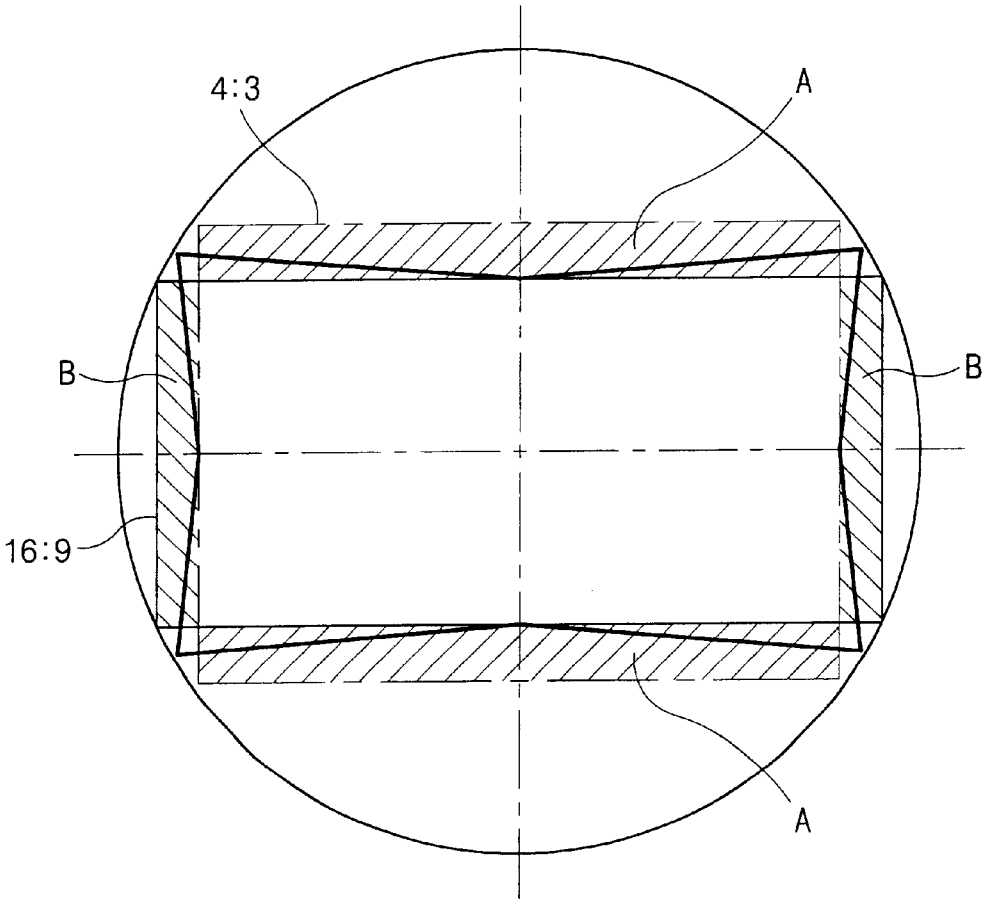
FIG. 9 is a graph showing an area variation of the yoke portion of th funnel depending on a screen ratio of a Braun tube in accordance with the preferred embodiment of the present invention.

The background of the design of the yoke portion 250 will now be described with reference to below Table 1 showing a funnel yoke portion design value according to a type of a CRT and FIG. 9 showing an area variation according to each design value.

TABLE 1

| Type | diameter | Diagonal angle | | Long axis | Short axis |
|---|---|---|---|---|---|
| ratio | mm | Rad | degree | mm | Mm |
| 4:3 | 50 | 0.64 | 36.89 | 40.00 | 30.00 |
| 16:9 | 50 | 0.51 | 29.37 | 43.58 | 24.51 |
| optimum | 50.0 | 0.51 | 29.37 | 40.00 | 24.51 |

| Area $mm^2$ | Area increase/decrease % | ΔH mm | ΔV mm | ΔHV mm | ΔHV/L |
|---|---|---|---|---|---|
| 1200 | 0 | 10.00 | 20.00 | 30.00 | 0.60 |
| 1068 | −10.979 | 6.42 | 25.49 | 31.91 | 0.64 |
| 1047 | −12.75 | 10.00 | 25.49 | 35.49 | 0.71 |

Figure 1:
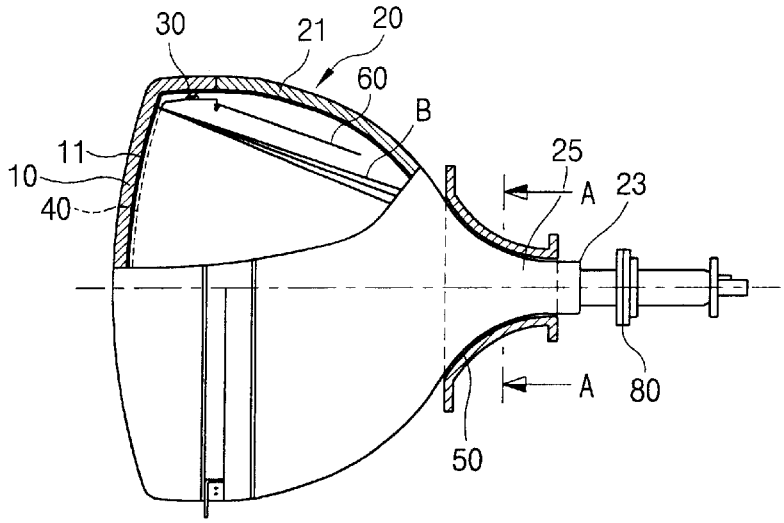
FIG.1 CONVENTIONAL ART
FIG. 1 is a partially cut side view showing an internal construction of a color CRT in accordance with one conventional art.
Figure 2:
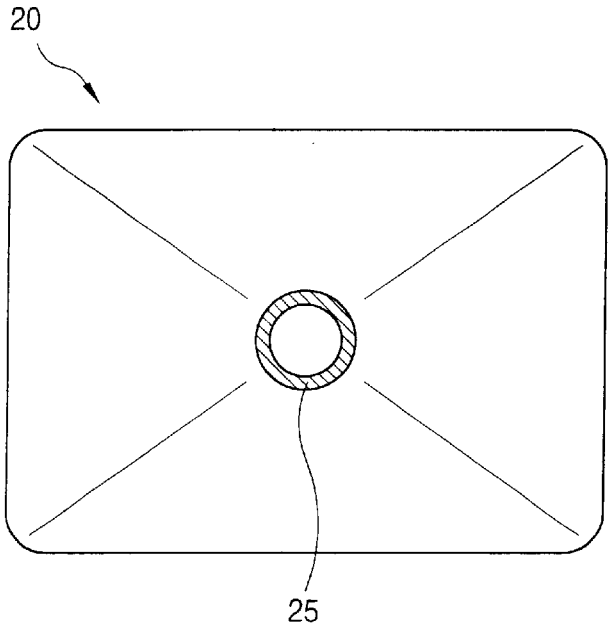
FIG.2 CONVENTIONAL ART
FIG. 2 is a sectional view taken along line of A—A of FIG. 1, showing a structure of a yoke portion of a funnel in accordance with one conventional art.

Typically, when the circular yoke portion as shown in FIG. 2 is designed, first a diagonal length with which no shade is made on the screen when the deflection yoke is operated is determined, and at the same time, a circular section having the deflection length as a radial is designed.

Figure 3:
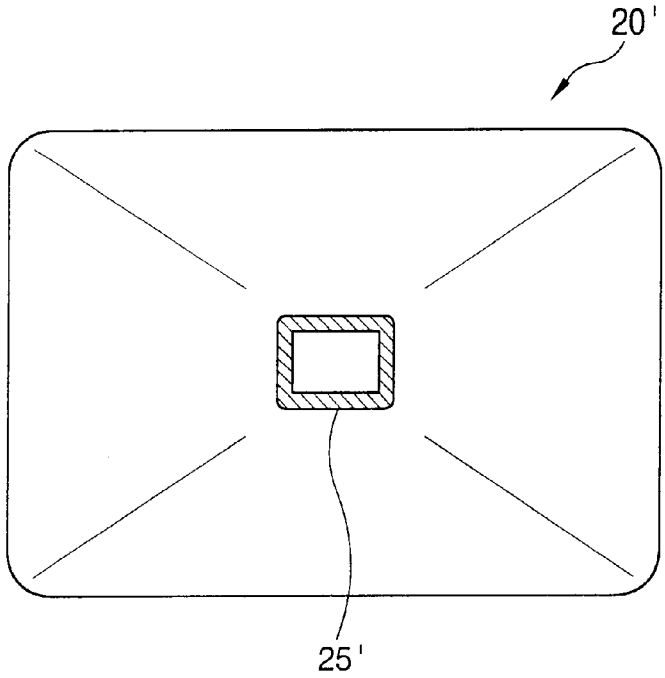
FIG.3 CONVENTIONAL ART
FIG. 3 is a sectional view showing a structure of a yoke portion of a funnel in accordance with another conventional art.
Figure 4:
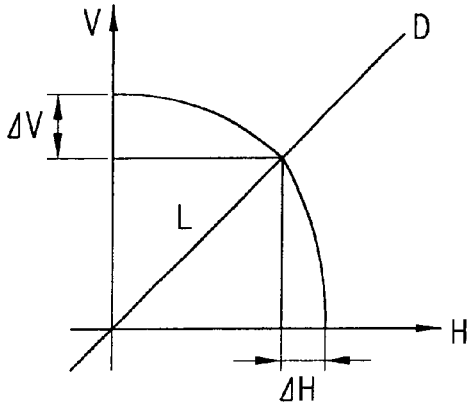
FIG.4 CONVENTIONAL ART
FIG. 4 is a graph for a reference of a design condition of the yoke portion of the funnel in accordance with another conventional art.
Figure 5:
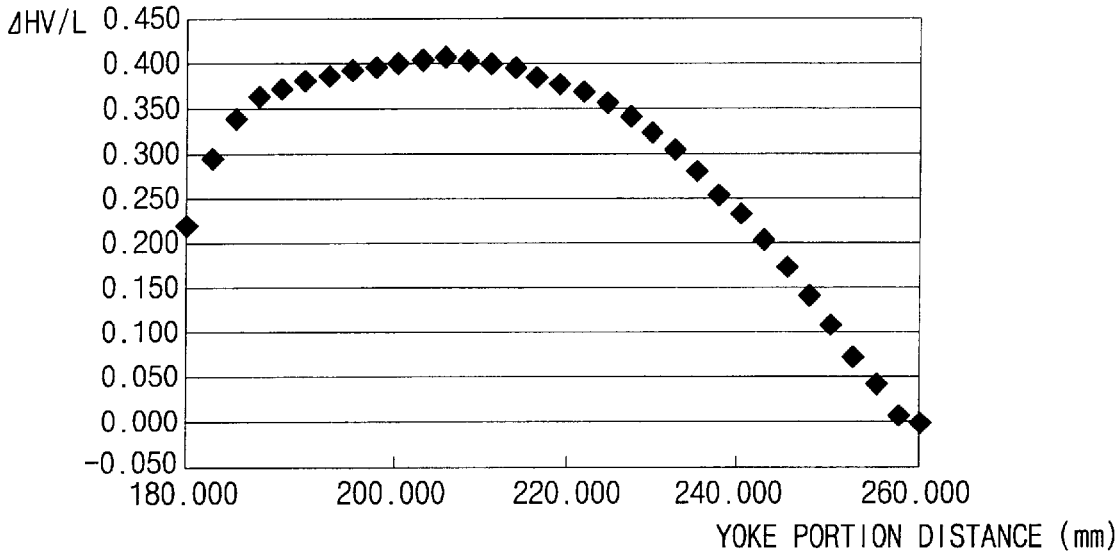
FIG.5 CONVENTIONAL ART
FIG. 5 is a graph showing a Δ HV/L value according to each portion of the yoke portion in accordance with another conventional art.

With reference to Table 1, on the assumption that a diameter at an arbitrary point of the yoke portion of the funnel as shown in FIGS. 3 and 6 is 50 mm, if the yoke portion has the screen ratio of 4:3, ΔHV/L is designed to be about less than 0.6.

However, if the screen ratio is 16:9, notably, the ΔHV/L is designed to be about 0.64.

At this time, if the yoke portion is designed to have 16:9 screen ratio, when increase and decrease in the deflection area of the short axis and the long axis in the ratio of 4:3 is compared, since a deflection power is over-designed as large as the reduced area of 10.979% as shown in Table 1 that is, as much as the ratio of a difference between the over-deflected area (2A) when the screen ratio is changed from 4:3 to 16:9 as shown in FIG. 9 and the over-deflected area (2B) when the screen ratio is changed from 16:9 to 4:3. Thus, the deflection power to be consumed can be reduced.

Especially, with the color CRT having the screen of 16:9, if there occurs a space between a deflection radius of the electron beam and the funnel, the long axis directional portion of the funnel can be reduced to a degree. Compared to the color CRT having the screen ratio of 4:3, the area of the yoke portion can be reduced by about 18.29%, and accordingly, the deflection power consumption can be optimized. At this time, as shown in Table 1, ΔHV/L has about 0.71 value.

In addition, the diameter, the diagonal length, of the yoke portion 250 can be shortened from 50 mm to 46.9 mm.

Referring to the yoke portion 250, as shown in FIG. 7, the thickness ($t_c$) of the corner portion is greater than each thickness ($t_v$ and $t_h$) forming both side faces and upper and lower faces.

The sectional area of the yoke portion 250 up to the outer surface is 900~1200 $mm^2$ from a reference line.

Generally, as for a strength distribution of a deflection magnetic field generated from a deflection coil, in order to have the maximum value at around the central portion of the deflection coil and make the outer diameter to be reduced from the peak value at the neck portion of the funnel where the deflection yoke is installed, it is effective to form the outer diameter of the funnel to be the same as the screen ratio, to thereby reduce the deflection power.

In addition, a leakage magnetic field is mostly generated from a horizontal deflection yoke. And since the front portion of the deflection yoke is opened in the panel direction, that is, the screen direction, a strong magnetic field is leaked to the panel direction and reaches far and wide. Thus, in order to reduce the leakage magnetic field from the deflection yoke, it is necessary to shorten the radius of the front portion of the deflection yoke as much as possible.

Shortening of the front portion of the deflection yoke has a close relation to the screen ratio, and in this respect, if a yoke portion optimized for the CRT having the screen ratio of 4:3 is applied, since the vertical width of the horizontal deflection coil is excessively enlarged, a power consumption and a leakage magnetic field are increased.

Accordingly, in order to prevent such a phenomenon, if the yoke portion of the CRT having the screen ratio of 16:9 is designed to satisfy the relational expression of 0.6<ΔHV<0.71 proposed by the present invention, the width in the vertical direction can be minimized.

In the preferred embodiment of the present invention, the external form of the yoke portion is mentioned, but the relational expression 0.6<ΔHV/L<0.71 can be also applied to the inner form of the funnel in the same manner to obtain the same effect.

Figure 10:
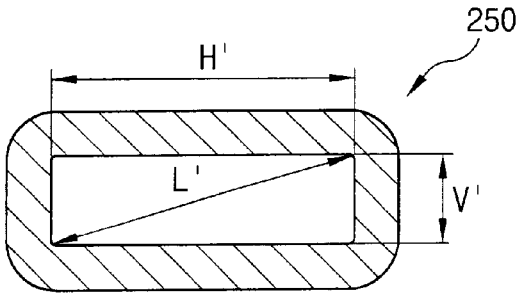
FIG. 10 is a sectional view for a reference of a design condition of an inner face of the yoke portion in accordance with the preferred embodiment of the present invention.

That is, as shown in FIG. 10, the inner face of the yoke portion 250 is designed to satisfy the relational expression of 0.6<ΔHV'/L'<0.71, of which 'L'' indicates a diagonal length of an outer face of the yoke portion, 'H'' indicates a long axis length of the outer face of the yoke portion, 'V'' indicates a short axis length of the outer face of the yoke portion, ΔH' indicates a difference between the diagonal length 'L'' and the long axis length 'H'', ΔV' indicates a difference between the diagonal length 'L'' and the short axis length 'V'', ΔHV' indicates the sum of ΔH' and ΔV'.

As so far described, the funnel of a color CRT in accordance with the present invention is constructed such that the design range of the yoke portion is optimized when the screen ratio is about 16:9, so that the high luminance and a high frequency are satisfied, the deflection power is reduced, and the leakage magnetic field is reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A color CRT having a body portion coupled to a panel, a neck portion in which an electron gun is installed and a yoke portion formed to be connected between the body portion and the neck portion and in which a deflection coil is mounted, wherein an outer face of the yoke portion satisfies a relational expression of 0.6<ΔHV/L<0.71, of which 'L' indicates a diagonal length of an outer face of the yoke portion, 'H' indicates a long axis length of the outer face of the yoke portion, 'V' indicates a short axis length of the outer face of the yoke portion, ΔH indicates a difference between the diagonal length 'L' and the long axis length 'H', ΔV indicates a difference between the diagonal length 'L' and the short axis length 'V', ΔHV indicates the sum of ΔH and ΔV.

2. The color CRT of claim 1, wherein the outer face of the yoke portion satisfies a relational expression of 0.64<ΔHV/L<0.71.

3. The color CRT of claim 1, wherein the yoke portion is formed in an about square shape, and the corner portion is thicker than both side portions and upper and lower portions.

4. The color CRT of claim 1, wherein a sectional area from a reference line to the outer face of the yoke portion is 900~1200 $mm^2$.

5. A color CRT having a body portion coupled to a panel, a neck portion in which an electron gun is installed and a yoke portion formed to be connected between the body portion and the neck portion and in which a deflection coil is mounted, wherein the yoke portion satisfies a relational expression of 0.6<ΔH'V'/L'<0.71, of which 'L'' indicates a diagonal length of an inner face of the yoke portion, 'H'' indicates a long axis length of the inner face of the yoke portion, 'V'' indicates a short axis length of the inner face of the yoke portion, ΔH' indicates a difference between the diagonal length 'L'' and the long axis length 'H'', ΔV'indicates a difference between the diagonal length 'L'' and the short axis length 'V'', ΔH'V' indicates the sum of ΔH' and ΔV'.

* * * * *